United States Patent [19]

Kobler

[11] 4,215,329

[45] Jul. 29, 1980

[54] POLARIZED ELECTROMAGNETIC MINIATURE RELAY

[75] Inventor: Ulrich Kobler, Munich, Fed. Rep. of Germany

[73] Assignee: Siemens Aktiengesellschaft, Berlin & Munich, Fed. Rep. of Germany

[21] Appl. No.: 905,229

[22] Filed: May 12, 1978

[30] Foreign Application Priority Data

May 23, 1977 [DE] Fed. Rep. of Germany ..... 2723220

[51] Int. Cl.[2] ..... H01H 51/22

[52] U.S. Cl. ..... 335/78; 335/79; 335/85

[58] Field of Search ..... 335/78, 79, 80, 81, 335/83, 84, 85, 229, 230, 234, 235

[56] References Cited

U.S. PATENT DOCUMENTS

| | | | |
|---|---|---|---|
| 3,987,383 | 10/1976 | Antonitsch | 335/78 |
| 3,999,156 | 12/1976 | Steenweijer et al. | 335/79 |
| 4,091,346 | 5/1978 | Nishimura et al. | 335/78 |

*Primary Examiner*—George Harris

*Attorney, Agent, or Firm*—Hill, Van Santen, Steadman, Chiara & Simpson

[57] ABSTRACT

Polarized relay with contact blade arranged within the coil body, and two yoke plates as counter contacts; a relatively large coupling surface between yoke and magnet, as well as an optimal space utilization for the magnet can be achieved with maximum exploitation of the relay cross section, by means of a four-pole magnet coupled at the front to the yoke plates or by means of two individual magnets.

18 Claims, 6 Drawing Figures

I
II
III
1
2
3
3a
3b
4
4a
4d
5
5a
5b
6
6a
6b
7
8
13
14
16
18
19
N
S 2
3
3a
4
4a
4b
4c
4d
5
7
8
13
16
17
19

5
5e
6
6e
9
9a
9b
9c
10
10a
10b
10c
11
11a
11b
12
12a
12b
14
15

POLARIZED ELECTROMAGNETIC MINIATURE RELAY

INTRODUCTION

This invention relates to a polarized electromagnetic miniature relay with a tongue armature which is arranged within the coil body approximately along the coil axis and is mounted at one end, and whose free end is arranged between two yoke plates while lie opposite one another and which also each form a pole shoe which is coupled to a permanent magnet arrangement arranged at the end of the coil body.

BACKGROUND OF THE INVENTION

A known relay of this type (German AS 24 59 039) possesses a two-part coil body into which the counter contacts, serving as a yoke, are injected, where the contact space is sealed by a magnet lying between the angled off counter contacts. In this known construction, the permanent magnet is polarized at right angles to the coil axis. This means that a large-area coupling to the permanent magnet poles can be achieved only at the expense of a long relay length or at the expense of a correspondingly shortened contact space or coil winding space. The coupling itself between the permanent magnet and the yoke elements injected in two coil halves is also not optimal.

The aim of the invention is to design a relay of the type described in the introduction in such a manner as to facilitate the best possible coupling of all the components which conduct the magnetic flux, and that in particular, in the permanent magnet arrangement, the existing space is exploited in optimal fashion. The permanent magnet arrangement is to possess the largest possible coupling surfaces and to represent the least possible proportion of the overall dimensions of the relay.

BRIEF SUMMARY OF THE INVENTION

In accordance with the invention this aim is realized in that the permanent magnet arrangement is designed to possess four poles with two polarization directions which are opposite to one another and parallel to the coil axis, in such a manner that the coupling surfaces between the two pole shoes and in each case one of two unlike pole faces of the permanent magnet arrangement are at right angles to the coil axis.

As a result of the end coupling of a four-pole permanent magnet, for example, a ferrite magnet which can be polarized in the direction of a short axis, it is possible to achieve a large coupling surface between magnet and pole shoes and an optimal exploitation of space for the magnet. As a result, the length of the magnet system within the relay can be kept short. When the overall relay is of a given length, consequently, more length is available for the armature, for example, its spring tongue and also a corresponding larger winding space.

Furthermore, the end-side coupling of two pole faces lying in one plane is subject to lower tolerances than the arrangement of a permanent magnet between two pole plates fixed in the coil body.

The permanent magnet arrangement can contain two permanent magnets exhibiting opposite polarity. However, it is expedient to employ one single permanent magnet magnetized with four poles. In this case, asymmetry of the contact force and of the response value can be compensated or deliberately achieved by means of an appropriate adjustment of the sub-zones of the magnet arrangement; in this way, it is possible to achieve a bistable or a monostable switching characteristic.

The two-pole faces, opposite to the pole shoes, of the permanent magnet arrangement are expediently coupled by means of a flux guidance plate arranged at the end side of the relay. In one preferred embodiment, the flux guidance plate consists of a ferromagnetic housing cap which can simultaneously close the exciter flux circuit. If the yoke plates and the armature serve as electric contact elements, expediently an insulating layer is arranged between the pole shoes on the one hand and the pole faces of the permanent magnet arrangement on the other hand. This layer can consist of a foil which simultaneously seals off, at the end, the coil interior which contains the contacts.

In a preferred embodiment, the two yoke plates are secured so as to be able to be plugged into lateral guide grooves of the coil body. These guide grooves can each possess dimensionally accurate bearing surfaces for those sides of the yoke plates which face towards the armature, and deformable ribs on the opposite sides. These bearing surfaces and the contact surfaces lie in one plane so that the contact spacing is determined only by the tolerance achieved in the coil body between the bearing surfaces. In order to keep the magnetic impedance for the control flux as low as possible, the yoke plates can form flux transfer components which bear against the ferromagnetic cap. It is also expedient for the yoke plates to exhibit a specific lateral play in their guide grooves. In order to achieve a tolerance adjustment, they can then in each case be displaced towards the housing cap so that the flux transition components form a close contact with the housing cap. The two yoke plates, with the molded on pole shoes and the flux transition components, can, in a particularly advantageous further development, be identical and inserted by appropriate rotation symmetrically to the coil axis.

In another preferred embodiment, the two yoke plates, together with the permanent magnet arrangement, forming a commonly mountable unit, are partially encased with synthetic material. This unit can be inserted, in shape-locking fashion, by projections into corresponding recesses in the coil body and simultaneously seal off the interior of the coil at the end.

The armature can be coupled, as a spring tongue or as a spring-mounted, rigid armature, to that end of the relay opposite the permanent magnet in a conventional manner and can be coupled to the flux-carrying housing cap. If it simultaneously serves to conduct current, the armature must naturally be electrically insulated, in the same way as the yoke plates, and provided with a terminal pin. The armature can likewise be adjusted in the normal manner by mechanical or magnetic influence at its clamping point.

BRIEF DESCRIPTION OF THE DRAWINGS

In the following, the invention will be explained in detail on the basis of exemplary embodiments, making reference to the drawing, in which.

DESCRIPTION OF PREFERRED EMBODIMENTS

Figure 1:
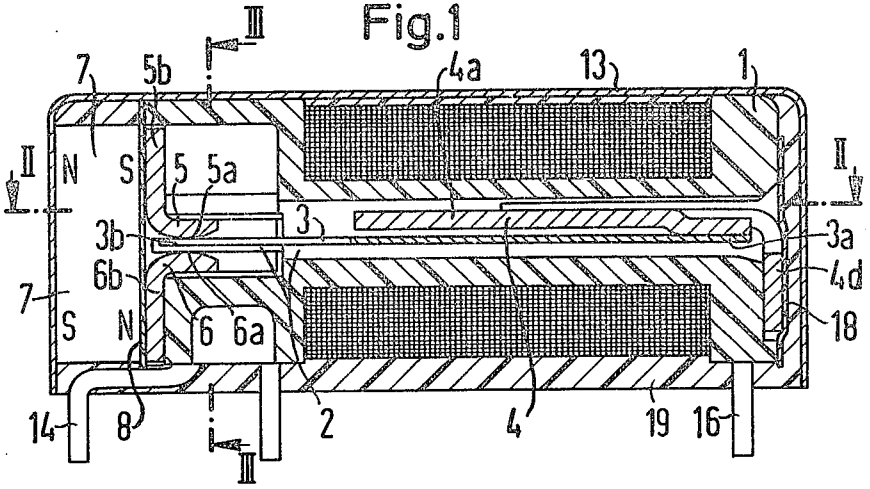
FIGS. 1, 2 and 3 illustrate a miniature relay designed in accordance with the invention in three sectional views.
Figure 2:
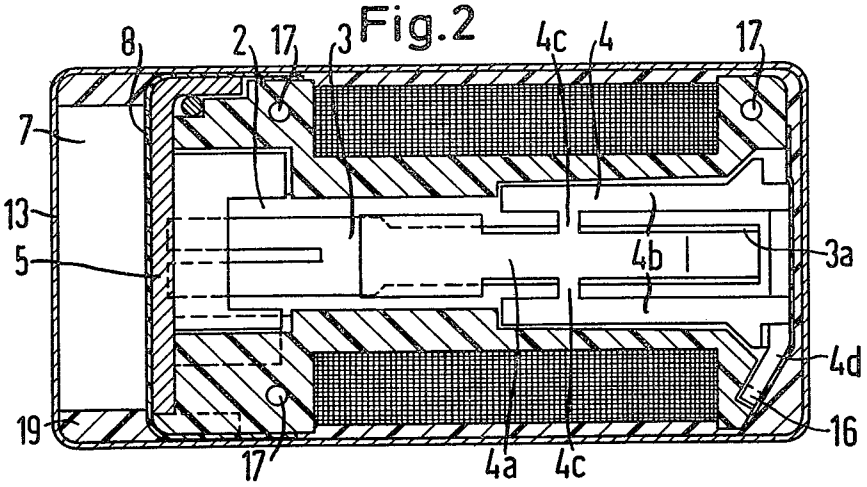
Figure 3:
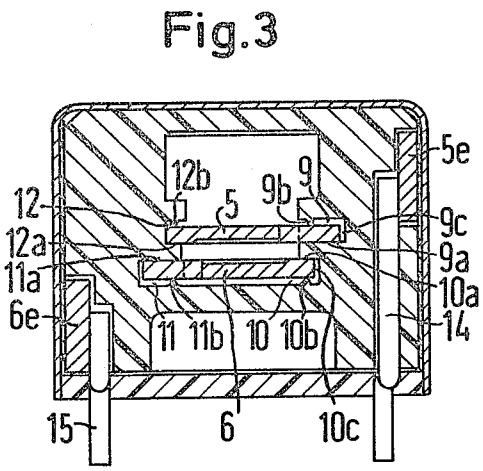

FIGS. 1 to 3 illustrate a polarized miniature relay with a coil body 1 which surrounds a contact space 2. In this contact space, approximately along the coil axis, there is arranged an spring armature 3 which is secured at one end 3a to a carrier 4. The latter itself possesses a central component 4*a* which runs in parallel with the spring armature 3 and is inserted by two lateral fixing strips 4*b* into grooves in the coil body. The central component 4*a* is connected merely via narrow arms 4*c* to the fixing strips 4*b* and can thus be adjusted by means of an externally connected magnetic field so that in this way the armature spring in the closed contact space can be adjusted from the exterior.

Opposite the free end 3*b* of the spring armature 3 are arranged two yoke plates 5 and 6 which, as contact elements, are provided with a contact bearing 5*a* and 6*a*, respectively. These yoke plates 5 and 6 are each angled off and thus form pole shoes 5*b* and 6*b* which are coupled flat to a pole face of a four-pole permanent magnet 7. An insulating foil 8 is arranged between the pole shoes and the permanent magnet.

The yoke plates 5 and 6 are secured so as to be able to be plugged into grooves 9, 10, 11 and 12 of the coil body 1. These grooves each form dimensionally accurate bearing surfaces 9*a*, 10*a*, 11*a*, and 12*a* for the surfaces of the yoke plates which face towards the armature. Furthermore, in the grooves there are formed deformable ribs 9*b*, 10*b*, 11*b* and 12*b*, which serve to press the yoke plates against the bearing surfaces. Thus, the contact spacing is determined solely by the tolerance achieved in the coil body between the bearing surfaces 9*a*, 10*a* and 11*a*, 12*a*.

Figure 4:
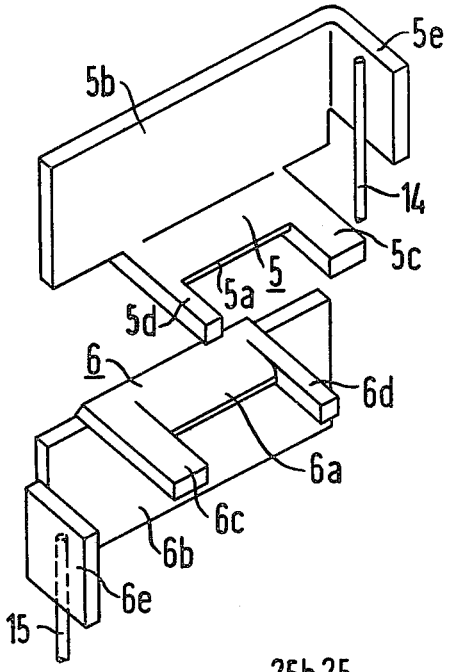
FIG. 4 illustrates the yoke plates from FIGS. 1 to 3 in a perspective view.

The two yoke plates 5 and 6 are each punched and curved in identical manner from one component, as illustrated in FIG. 4. These two identical parts are merely rotated relative to one another by 180°, so that their contact surfaces 5*a* and 6*a* lie opposite one another. The fixing portions 5*c*, 5*d* and 6*c*, 6*d* which are arranged laterally to the contact surfaces 5*a* and 6*a* produce relatively long clamping surfaces in the grooves 9, 10, 11 and 12 of the coil body 1. The laterally angled flux transition components 5*e* and 6*e* finally produce a good coupling to the ferromagnetic housing cap 13. In order to keep the magnetic impedance from the control flux as low as possible, the yoke plates 5 and 6 can be laterally displaced in the grooves 9, 12 and 10, 11. The insertion width in the coil body, therefore, exhibits a certain play 9*c* and 10*c* relative to the width of the yoke plates 5 and 6.

The flux transition components 5*e* and 6*e* are also welded to electric terminal pins 14 and 15, which are designed to be offset so that they emerge from the relay housing in a specific grid pattern. Futhermore, the squared off part 4*d* of the carrier for the armature spring is provided with a contact terminal 16. Terminal pins 17 for the coil windings are embedded into the coil body. That end of the coil body 1 which is opposite to the permanent magnet 7 is also covered by an insulating foil 18. The remaining space between the coil body 1 and the protective cap 13 is filled with a sealing compound 19.

Figure 5:
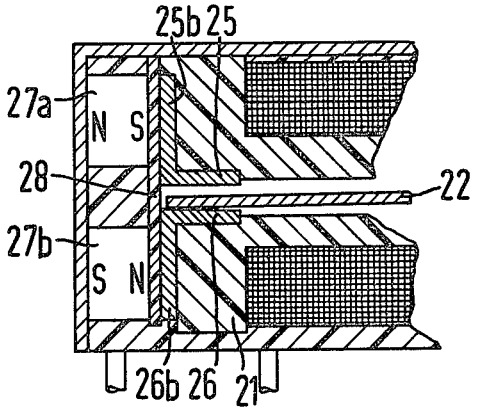
FIG. 5 illustrates a magnet system with two permanent magnets.

FIG. 5 illustrates a relay with a magnet arrangement which is slightly modified in comparison to FIG. 1. The coil body 21 is constructed with an armature spring 22 and the yoke plates 25 and 26, similarly to the previously described relay. In place of the four-pole, single permanent magnet employed therein, two oppositely poled permanent magnets 27*a* and 27*b* located one above another have been used. Here again, an insulating foil 28 serves to seal off the contact space and for electrical insulation.

Figure 6:
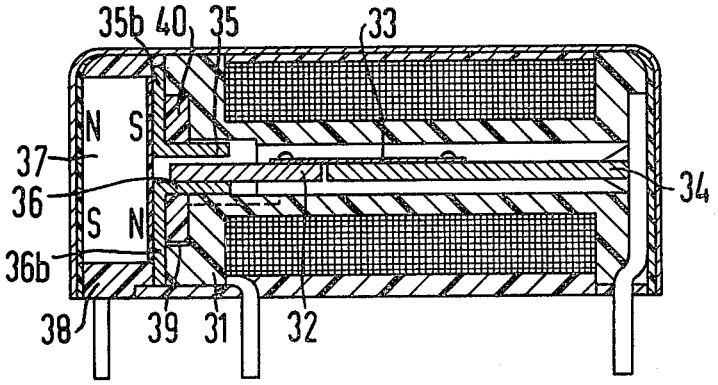
FIG. 6 illustrates a relay with an assembly unit formed from the yoke plates and the permanent magnet.

FIG. 6 illustrates another variant. In the coil body 31 which is designed similar to the above described embodiments, there is now arranged, for example, a rigid armature 32 which is secured by means of a bearing spring 33 on a flux plate 34. In contrast to the previously described exemplary embodiments, here the two yoke plates 35 and 36, together with the four-pole permanent magnet 37, are embedded in a common insulating block 38 which can be mounted as a separate unit, at one end of the coil body 31. For this purpose, the coil body 31 is provided with recesses 39 into which the insulating block 38 can be inserted in shape-locking fashion by appropriate projections 40. Otherwise, the construction of the relay is similar to FIG. 1.

It will be apparent to those skilled in the art that many modifications and variations may be effected without departing from the spirit and scope of the novel concepts of the present invention.

I claim as my invention:

1. Polarized electromagnetic miniature relay with a tongue armature which is arranged within the coil body approximately along the coil axis and is mounted at one end, and the free end of which is arranged between two yoke plates located opposite one another which also each form a pole shoe which is coupled to a permanent magnet arrangement arranged on one end of the coil body, said permanent magnet arrangement being designed with four poles with two polarization directions which are opposite to one another and parallel to said coil axis, the coupling surfaces between said two pole shoes and in each case of two unlike pole faces of said permanent magnet arrangement being at right angles to said coil axis.

2. Relay as claimed in claim 1, in which a flux guidance plate is provided at said end side of said relay and in which said two pole faces, opposite to said pole shoes of said permanent magnet arrangement are coupled to one another by said flux guidance plate.

3. Relay as claimed in claim 2, in which a ferromagnetic housing cap serves as said flux guidance plate.

4. Relay as claimed in claim 3, in which said permanent magnet arrangement is formed by one single permanent magnet magnetized with four poles.

5. Relay as claimed in claim 4, in which said permanent magnet arrangement is adjusted asymmetrically.

6. Relay as claimed in claim 5, in which said yoke plates and said armature are designed as electric contact elements, and in which an insulating layer is arranged between said pole shoes and said pole faces of said permanent magnet arrangement.

7. Relay as claimed in claim 6, in which said insulating layer also seals the interior of said coil at said end side.

8. Polarized electromagnetic miniature relay with a tongue armature which is arranged within the coil body approximately along the coil axis and is mounted at one end, and the free end of which is arranged between two yoke plates located opposite one another which also each form a pole shoe which is coupled to a permanent magnet arrangement arranged on one end of the coil body, said permanent magnet arrangement being designed with four poles with two polarization directions which are opposite to one another and parallel to said coil axis, the coupling surfaces between said two pole shoes and in each case of two unlike pole faces of said permanent magnet arrangement being at right angles to said coil axis, in which a ferromagnetic housing cap serves as a guidance plate, and in which flux transition components which lie laterally against said housing cap are formed on said yoke plates.

9. Polarized electromagnetic miniature relay with a tongue armature which is arranged within the coil body approximately along the coil axis and is mounted at one end, and the free end of which is arranged between two yoke plates located opposite one another which also each form a pole shoe which is coupled to a permanent magnet arrangement arranged on one end of the coil body, said permanent magnet arrangement being designed with four poles with two polarization directions which are opposite to one another and parallel to said coil axis, the coupling surfaces between said two pole shoes and in each case of two unlike pole faces of said permanent magnet arrangement being at right angles to said coil axis, in which lateral guide grooves are provided in the inner wall of said coil body and in which said yoke plates are secured so as to be able to be plugged into said lateral guide grooves of said coil body.

10. Relay as claimed in claim 9, in which said guide grooves each possess dimensionally accurate bearing surfaces for those sides of said yoke plates which face towards said armature and deformable ribs on the walls opposite said bearing surfaces.

11. Relay as claimed in claim 9, in which said yoke plates are arranged in said guide grooves with lateral play.

12. Relay as claimed in claim 8, in which said two yoke plates are of identical design and secured approximately symmetrically to the coil axis, rotated relative to one another, in said coil body.

13. Relay as claimed in claim 8, in which terminal pins are provided secured to said two yoke plates.

14. Relay as claimed in claim 1, in which said yoke plates, together with said permanent magnet arrangement are embedded in an insulating block and commonly positioned on the coil body.

15. Relay as claimed in claim 14, in which said connecting components which engage with one another in shape-locking fashion are provided on said coil body and on the applied insulating block.

16. Polarized electromagnetic miniature relay with a tongue armature which is arranged within the coil body approximately along the coil axis and is mounted at one end, and the free end of which is arranged between two yoke plates located opposite one another which also each form a pole shoe which is coupled to a permanent magnet arrangement arranged on one end of the coil body, said permanent magnet arrangement being designed with four poles with two polarization directions which are opposite to one another and parallel to said coil axis, the coupling surfaces between said two pole shoes and in each case of two unlike pole faces of said permanent magnet arrangement being at right angles to said coil axis, in which lateral guide grooves are provided in the inner wall of said coil body and in which said yoke plates are secured so as to be able to be plugged into said lateral guide grooves of said coil body, in which said guide grooves each possess dimensionally accurate bearing surfaces for those sides of said yoke plates which face towards said armature and deformable ribs on the walls opposite said bearing surfaces, and in which said yoke plates are arranged in said guide grooves with lateral play.

17. Relay as claimed in claim 8, in which said two yoke plates are of identical design and secured approximately symmetrically to the coil axis, rotated relative to one another in said coil body, and in which terminal pins are provided secured to said two yoke plates.

18. Relay as claimed in claim 1, in which said two yoke plates are of identical design and secured approximately symmetrically to the coil axis, rotated relative to one another in said coil body.

* * * * *